US005437330A

United States Patent [19]

Gambertoglio

[11] Patent Number: 5,437,330

[45] Date of Patent: Aug. 1, 1995

[54] LINER CEMENTING SYSTEM AND METHOD

[75] Inventor: Louis M. Gambertoglio, The Woodlands, Tex.

[73] Assignee: Baker Hughes Incorporated, Houston, Tex.

[21] Appl. No.: 281,466

[22] Filed: Jul. 27, 1994

[51] Int. Cl.[6] ..... E21B 33/13

[52] U.S. Cl. ..... 166/289; 166/154

[58] Field of Search ..... 166/154, 155, 156, 285, 166/289, 291

[56] References Cited

U.S. PATENT DOCUMENTS

| | | | |
|---|---|---|---|
| 2,435,016 | 1/1948 | Pitts | 166/154 |
| 2,633,916 | 4/1953 | Baker et al. | 166/155 |
| 2,998,075 | 8/1961 | Clark, Jr. | 166/155 |
| 4,602,684 | 7/1986 | Van Wormer et al. | 166/285 |
| 4,842,069 | 6/1989 | Baugh et al. . | |
| 4,862,966 | 9/1989 | Lindsey et al. | 166/382 |
| 4,880,058 | 11/1989 | Lindsey et al. | 166/289 |
| 5,052,488 | 10/1991 | Fraser, III . | |
| 5,058,671 | 10/1991 | Cochran | 166/124 |
| 5,058,672 | 10/1991 | Cochran | 166/124 |

OTHER PUBLICATIONS

Catalogue: "Liner Hangers," Baker Hughes Incorporated, 1994.

"Product Report," Baker Service Tools, 1991.

*Primary Examiner*—Ramon S. Britts

*Assistant Examiner*—Frank S. Tsay

*Attorney, Agent, or Firm*—Browning, Bushman, Anderson & Brookhart

[57] ABSTRACT

A liner cementing system and method provide for a landing collar 10 with a bypass passageway 45. Circulation port 62 in collar 10 permits initial circulation through the liner 17 until a pump down plug P1 is pumped therein to seal off circulation therethrough. An increase in pressure in the liner bore 51 acts on a piston 50 until shear ring 48 is sheared at a selected pressure. Cement 90 may then flow through the bypass passageway 45 into a cement shoe 104 and into an annulus 74 to cement the liner 17 in place. Pump down plug P2 seals off the bypass passageway 45 to stop flow into the annulus 74. The closing of circulation port 62, the opening of bypass port 53, and the closing of bypass port 53 produce pressure signals at the surface which may be used to analyze cement job success.

20 Claims, 2 Drawing Sheets

LINER CEMENTING SYSTEM AND METHOD

BACKGROUND OF THE INVENTION

1. Field of the Invention

The present invention relates generally to equipment and methods for cementing liners in a wellbore. More particularly, this invention relates to a landing collar with a pressure indicator/bypass for use within a two plug cementing system.

2. Description of the Background

Liners have long been used in oil and gas recovery operations for many purposes, including completion flexibility, well control, reducing initial casing costs, repair purposes, and well deepening. In hydrocarbon recovery operations, a liner generally refers to a section or string of tubing, casing, or other similar oilfield tubular that is secured downhole within a larger diameter downhole tubular. Liners normally do not extend to the surface, and are sometimes referred to as a short string. A short string liner is typically fixed within a larger diameter casing and is structurally interconnected with the casing by a slip assembly. The short string liner may extend downward from the casing into an open hole region below the bottom of the casing.

It is often desirable to cement the liner into place by positioning cement into the annulus directly surrounding the liner. For this purpose, pump down plugs may be used both in front of and behind a column of cement that is pumped through the liner for circulation to this annulus about the liner. The pump down plugs isolate the cement column from other wellbore fluids, such as displacing fluids. The plugs also perform a wiping or cleaning function. In this way, the cement is ideally positioned directly within the annulus surrounding the liner, and the interior of the liner is preferably substantially free of cement.

In a typical short string liner system, the pump down plug engages a liner wiper plug which may be pre-positioned within the liner. The pump down plug and liner wiper plug are forced downwardly simultaneously within the liner string to displace the cement therefrom and to wipe the inner walls of the liner. One prior art system promoted by Baker Service Tools is the CF-Four Plug System, Product No. 269–25. Further details regarding prior art systems are disclosed in U.S. Pat. Nos. 4,842,069 and 5,052,488.

Several problems arise from the use of the Four Plug System that may result in a poor or failed cement job, or that may relate to the inability of the operator to distinguish at the surface whether the cement job is satisfactory. When problems occur or when it cannot be determined at the surface that the cementing job was successful, any apparently necessary repair may be costly and time consuming, depending on the type of apparent failure.

Even if the downhole components perform correctly, it is often difficult to accurately discern at the surface (1) when each liner wiper plug has been engaged by a respective pump down plug, (2) when the liner wiper plug is sheared from its position, and (3) when the pump down plug/liner wiper plug combination is set in its final position at the lower end of the liner to perform its designated function. Accordingly, the well operator may not know whether to advise performing a corrective squeeze job to squeeze additional cement behind the liner and, if so, how much cement preferably will be used for the squeeze job.

Other problems with prior art cementing operations may also arise. For various reasons, a liner wiper plug may shear prior to the time it was intended to shear, thereby causing a failed cement job. Multiple liner wiper plugs that are intended to drop sequentially may drop simultaneously. In some cases, one or more liner wiper plugs may not shear as intended. Because the cement column is typically already moving downwardly toward or through the liner when such problems occur, the cement may set up in a manner that makes repair difficult. Such problems may be accentuated if the hole tends to be more horizontal.

When two or more pump down plugs are used in a Four Plug System, each plug is sized differently to properly engage the correct one of the two downhole liner wiper plugs. If the pump down plugs are inadvertently dropped in the wrong order, then the operation fails.

Another problem arises if it is necessary to drill out the cementing shoe. The pump down plug or liner wiper plug (or combination thereof) may rotate with the drill bit to make drilling difficult.

A general problem is that the use of one or more pump down plugs with one or more liner wiper plugs requires fairly complex equipment that, for various reasons, lends itself to a greater likelihood of job failure.

There remains a need for less complex liner cementing equipment that offers more dependable operation at reduced levels of capital investment. Those skilled in the art have long sought and will appreciate that the present invention provides solutions to these and other problems. The disadvantages of the prior art are overcome by the present invention, and an improved cementing system is hereinafter disclosed for reliably setting a liner within the wellbore. Another aspect of the invention is an improved method of setting a liner in a wellbore, and also an improved landing collar for operating with plugs during the cementing operation.

SUMMARY OF THE INVENTION

The present invention includes components used for positioning a cementatious material in an annulus surrounding a liner within a wellbore. The system components comprise a landing collar having an outer housing and an inner body. The inner body is disposed within the outer housing, and has a circulation port therethrough for circulating fluid through the liner. The landing collar inner body defines a central flow passageway for communicating between a bore within the liner longitudinally above a circulation port and a bore within the liner longitudinally below the circulation port. The landing collar inner body further includes a circulation port which is opened by surface pumping operations for regulating flow through a bypass flow passageway when the central flow passageway is blocked. First and second pump down plugs are provided with the system. The first pump down plug cooperatively seals with the tubular above the liner and subsequently with the liner, and finally seals against the landing collax to block the central flow passageway and thereby generate fluid pressure, which can be monitored and regulated at the surface, opens the circulation port. The second pump down plug also cooperates with both the tubular above the liner and the liner, and finally seals against the landing collar to subsequently close the bypass flow passageway.

The method of the invention includes running the liner into the wellbore to a desired depth within the wellbore with the landing collar secured to a work string. An open central flow passageway is provided within a lower end of the landing collar. A pressure sensitive circulation port in the landing collar opens to control flow through the bypass passageway. Circulation fluid may be pumped through a flow column extending through the liner, and through the central flow passageway. The first pump down plug may then be placed into the flow column. The cementing material to be positioned in the annulus about the liner is placed in the flow column subsequent to the first pump down plug. The first pump down plug is used to seal off circulation through the central flow passageway of the landing collar. The fluid pressure to the landing collar is increased after sealing the central flow passageway, thereby automatically opening the circulation port. All downhole fluid pressure changes may be monitored at the surface during the cementing operation. The cementing material is then pumped through the circulation port and through the bypass passageway, through the downstream portion of the liner, and into the annulus about the liner. The second pump down plug is placed within the flow column subsequent to the cementatious material. The bypass flow passageway is sealed with the second pump down plug.

It is an object of the present invention to provide an improved liner cementing system and method.

It is another object of this invention to provide a cementing system that produces a clearly discernible pressure signal at the surface indicative of releasing cementatious material into the wellbore.

It is yet another object of the present invention to provide an improved landing collar with a surface controllable bypass passageway.

A feature of the invention is a landing collar with a pressure sensitive circulation port to easily control flow of cementatious fluid through the bypass passageway.

Another feature of the present invention is a system wherein the pump down plugs may be identical, and may be formed from a rigid central body and rubber or elastomeric exterior material.

An advantage of the present invention is the elimination of the need for downhole liner wiper plugs.

Another significant advantage of the present invention is increased reliability of operation.

Yet another advantage is a less complex cementing system that may be used with other equipment downhole, such as a ball seat sub within or below the landing collar for operation of a hydraulic liner hanger.

These and further objects, features, and advantages of the present invention will become apparent from the drawings, the descriptions given herein, and the appended claims.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENTS

Figure 1A:
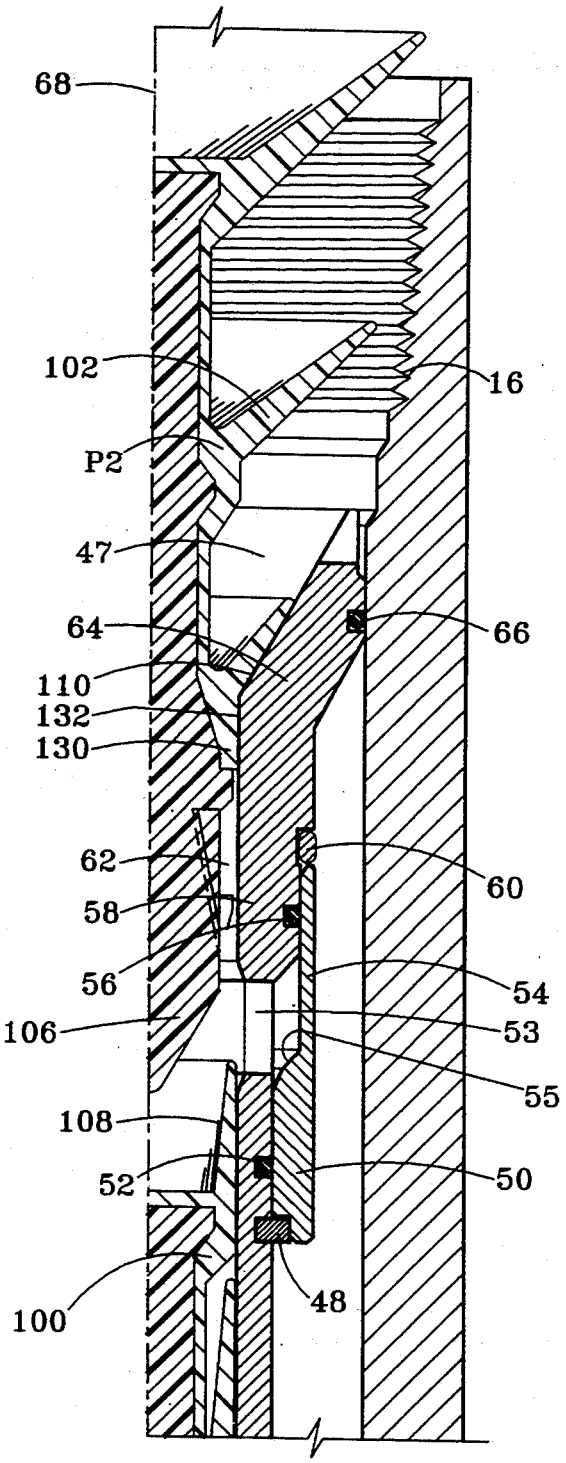
FIG. 1A is an elevational view, in section, of the upper portion of a landing collar with a bypass passageway in accord with the present invention.
Figure 1B:
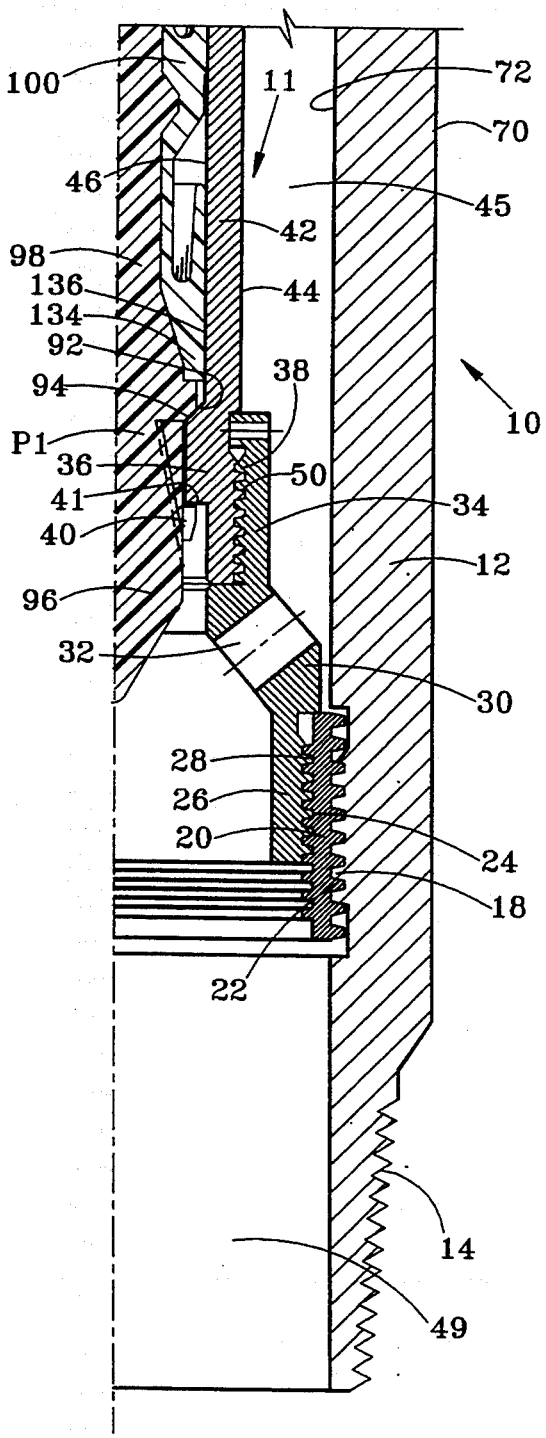
FIG. 1B is an elevational view, in section, of the lower portion of the landing collar of FIG. 1A.

With reference to FIG. 1A and FIG. 1B., a landing collar 10 in accord with the present invention is illustrated. Landing collar 10 includes housing 12 having lower and upper threaded connections 14 and 16, respectively, for securing landing collar 10 within a lower end 13 of liner string 17 (see FIG. 2) that is to be secured by the cement within wellbore 15.

The landing collar 10 includes an inner body 11 within the housing 12, with the inner body including lower body portion 30 and upper body portion 42. Lower inner body portion 30 defines bypass port 32 as discussed further hereinafter. Outer housing 12 includes preferably inner threads 18 to engage outer threads 22 of split lock ring 20. Split lock ring 20 also has interior threads 24 to engage corresponding exterior threads 28 of lower connector 26 of inner body portion 30. Lower inner body portion 30 also includes retaining ring 34 for securing base member 36 thereto via threads 38 and 50. Latch ring 40 engages ledge 41 of base member 36 to secure pump down plug P1 in position after it has been positioned within bore 46, as shown in FIG. 1B. The plug P1 seals with the inner body 11, and, more particularly, the molded O-ring 134 of plug P1 seals against surface 136 of the inner body. Base member 36 supports upper body portion 42 inside housing 12.

Figure 2:
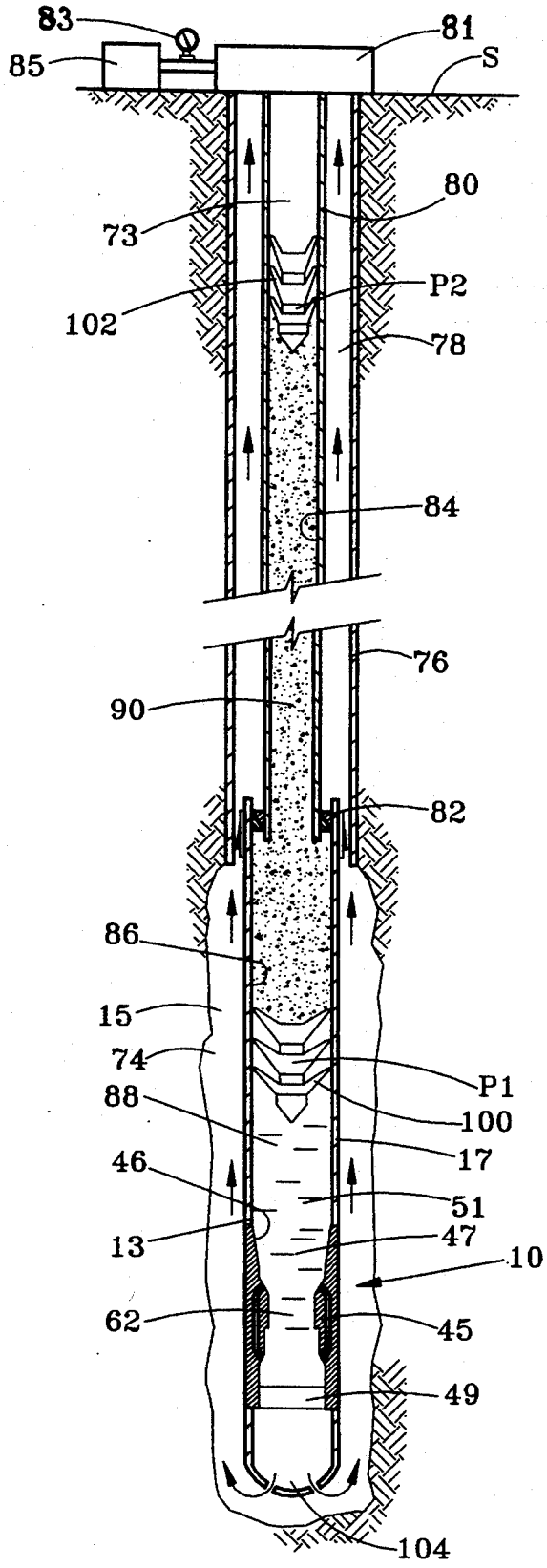
FIG. 2 is an elevational view, in section, of a system incorporating the landing collar as shown in FIG. 1A and 1B.

Outer cylindrical surface 44 of upper body portion 42 and inner surface 72 of housing 12 define a bypass passageway 45 that communicates between upper bore 47 and lower bore 49 of landing collar, and thus between the bore 51 in liner string 17 and the annulus 74 about the liner string in FIG. 2. Inner cylindrical surface 46 primarily defines the interior circulation port through the landing collar 10.

Upper and lower O-ring seals 56 and 52 and piston 50 seal port 53 to prevent leakage or bleed off therethrough that might affect differential pressure buildup across piston 50. Metal snap ring 60 maintains the position of piston 50 and prevents upwardly movement of piston 50. Upper body 58 supports landing collar 64 which is sealed to housing 12 by O-ring 66. Longitudinal axis 68 extends through liner 17 and landing collar 10. Outer housing surface 70 approximates the outer diameter of liner 17 and thus the landing collar 10. Port 53 opens after shear ring 48 is sheared due to differential pressure between the interior and the exterior of the body 11 and the difference in the diameters of seals 56 and 52. Opening port 53 opens the bypass passageway 45 as will be discussed hereinafter with respect to operation of landing collar 10. Pressure acting on surface 55 of piston 50 force piston 50 axially downwardly to open port 53.

With reference to FIG. 2, a circulation flow column 73 is provided between the surface S and the liner 17. Fluid flow may thus be down through operating or work string 80 then upwardly through annulus 74 surrounding liner 17 and into the annulus between casing 76 and string 80, as shown in FIG. 2. Liner 17 is positioned within borehole 78 from operating string 80, and is interconnected therewith by sealed connection 82. Operating string 80 has a smaller internal diameter 84 than the internal diameter 86 of liner 17, so that the lower end of string 80 is inserted therein as shown in FIG. 2. The operation of the present system is most effective when the change in diameter between the operating string 80 and liner 17 is not extensive, which normally is the case with slim hole liners. In this manner, the fins 100 and 102 of pump down plugs P1 and P2, respectively, can most effectively separate downhole fluids from the cement and wipe the interior surfaces of work string 80 and liner 17.

After circulation is established with circulation fluid 88, pump down plug P1 is pumped into the operating string 80 and into liner 17. It will be understood that pump down plugs P1 and P2 may be disposed in a plug dropping head 81 located at surfaces for placement into flow column 73 at the desired time. Cement slurry or other cementing material 90 that is desired to be placed within annulus 74 about the liner 17 is positioned in flow column 73 behind pump down plug P1.

Pump down plug P1 is pumped downwardly through liner 17 and into central flow passageway 62 substantially as shown in FIG. 1B. Pump down plug P1 stops when annular catch surface 92 adjacent nose 96 engages corresponding stop surface 94 to prevent further downward movement of plug P1. Latch ring 40 engages ledge 41 to prevent plug P1 from backing outwardly from passageway 62. Preferably, the solid phenolic body 98 of each plug cooperates with the elastomeric fins 100 and 0tings 130 molded on body 98 to seal circulation port 62 along sealing surfaces, such as 46 and 132, to prevent further circulation therethrough. The stoppage of passageway 62 produces a clearly distinguishable pressure buildup signal that can be observed by sensor 83 at the surface and recorded for job analysis purposes.

Prior to sealing of passageway 62, the pressure differential across piston 50 was substantially zero because port 32 allowed equalization of the pressure between between bypass passageway 45 and bore 47. After passageway 62 is sealed, the pump pressure in the bore of liner 17 continues to increase, thereby producing a differential pressure buildup across piston 50. Shear ring 48 is designed to shear at a predetermined pressure differential. When the job continues, the pressure in liner bore 51 will build up to a predetermined or selected amount, and then suddenly decrease as shear ring 48 shears to allow piston 50 to move downwardly and open circulation port 53 and then bypass passageway 45.

The surface pressure readout versus time should show a pulse to designate the beginning of the entry of cement or other material 90 through port 53. The cement, slurry, or other material 90 continues through central flow passageway 62, through bypass passageway 45, then through port 32, into bore 49, through cementing shoe 104, and into liner annulus 74 (see FIGS. 1B and 2). The operation of the system allows for a full turbulent flow of cement to provide the highest quality cementing job without the problems of a partial or weak flow that is more likely to occur with more complex prior art cementing systems that may not operate as expected.

Pump down plug P2 is inserted into flow column 73 after the desired amount of cement, slurry, or other material 90 is pumped into operating string 80. After the desired amount of material 90 is pumped behind liner 17, pump down plug P2 engages landing collar 64 (see FIG. 1 ) to seal bypass passageway 45 and stop further circulation. Fins 102 on pump down plug P2 wipe and clean operating string 80 and then expand to wipe and clean liner 17. It is thus desirable that fins 102 be able to expand sufficiently for this purpose from a smaller inner diameter operating string to a larger diameter liner.

Nose 106 and latch ring 40 of pump down plug P2 may solidly engage last fin 108 to wedge pump down plug P2 in position to prevent rotation during any subsequent drilling out of the plug. The present system is thus also preferable in that the plugs are secured by their nose portion so that they are less likely to rotate and thereby impede drilling out operations. Inner body 11 is secured to housing 12 in a manner that will prevent rotation of body 11 during cement cleanup operations. The materials of the plugs and other components to be drilled out may be of materials that are easy to drill.

Pump down plug P2 thus engages and seals with pump down plug P1 and/or with other surfaces 132 on the inner body 11 disposed above port 53 of bypass passageway 45. Breaking the seal of bypass passageway 45 produces a clearly discernible sharp pressure drop at the surface, and the subsequent sealing of plug P2 and the inner body 11 thereafter shows precisely when the cement stopped flowing into annulus 74. A record of pressure versus time, along with other information such as flow rates, provides a means for determining the quality of the cement job at the surface so the operator can give an informed opinion of any other steps which may be necessary to complete the cementing operation in a satisfactory manner.

The simplicity of the present system also allows for other downhole operations relating to the process of cementing the liner. For instance, the present system allows for dropping of a ball, plug, or other object through landing collar 10 to operate other devices, such as a hydraulic liner hangers. Hydraulic liner hanger operating equipment may include a Baker Product No. 299–91 ball catcher sub below the ball seat.

Figure 3:
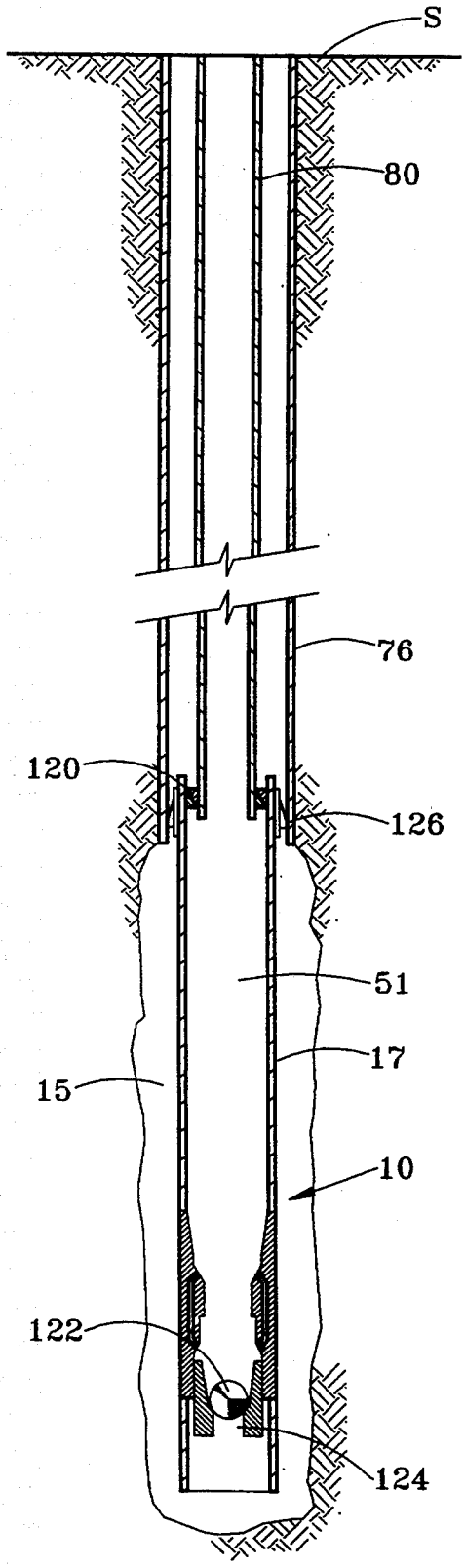
FIG. 3 is an elevational view, in section, of a system in accord with the present invention having a hydraulic liner hanger disposed above the landing collar and a ball seat below the landing collar.

As shown in FIG. 3, hydraulic liner hanger 126 may be used to hang or secure liner 17 to casing 76. Hydraulic liner hanger 126 is activated upon an increase in pressure that occurs after ball 122 is pumped through liner 17 and into ball seat sub 124, thereby producing a pressure increase within bore 51 of liner 17. The resulting pressure increase moves a piston (not shown), which in turn moves the slips of the liner hanger 126 into engagement with casing 76. After setting liner hanger 126, the plugs may be pumped from the surface to commence the cementing operation as described above. Those skilled in the art will appreciate that the ball seat may be provided within the landing collar, rather than being threaded below the landing collar, and preferably may be integral with the landing collar. Other hydraulically operated systems may also be used as desired with the less complex system of the present invention. The landing collar of the present invention may also be used with other downhole tools, such as mechanically set hangers.

While descriptive terms such as "above" and "below" have been used herein to aid understanding of the present invention, it will be understood that these terms refer to the relative location of the components as illustrated in the accompanying drawings. Components may be disposed in different relationships in operation, storage, or transportation, as will be understood by those skilled in the art. It is thus not intended that the invention be construed as being limited in any manner by such terminology. Those skilled in the an will appreciate that the present invention may be used with any type of generally cementatious material suitable for cementing a liner in a wellbore. Also, a rupture disk or other valve-type member could replace the piston 50 discussed herein.

The foregoing disclosure and description of the invention is illustrative and explanatory thereof, and it will be appreciated by those skilled in the art, that various changes in the size, shape and materials as well as in the details of the illustrated construction or combinations of features of the various cementing system elements may be made without departing from the spirit of the invention.

What is claimed is:

1. A method of cementing an annulus surrounding a liner within a wellbore, comprising:

running the liner to a desired depth within the wellbore with a landing collar secured to and extending below the liner to form a flow column through the liner and the landing collar;

providing a bypass passageway for communication between a bore within the liner longitudinally above the landing collar and a bore within the liner longitudinally below the landing collar;

sealingly blocking a circulation port within the landing collar for controlling flow through the bypass passageway;

pumping circulation fluid through the flow column extending through the liner and the landing collar;

placing a first pump down plug into the flow column;

thereafter positioning a cementatious material in the flow column;

blocking circulation through the landing collar with the first pump down plug;

blocking circulation through the bypass passageway;

thereafter increasing fluid pressure within the liner above the landing collar until the circulation port is opened;

pumping the cementatious material through the opened circulation port, through the bypass passageway, and into an annulus surrounding the liner;

placing a second pump down plug within the flow column subsequent to positioning the cementatious material in the flow column; and sealing the circulation port from fluid above the second downhole plug with the second pump down plug.

2. The method as defined in claim 1, further comprising:

inserting an operating string into the wellbore for fluid communication with the bore in the liner, the operating string having an interior diameter less than an interior diameter of said liner; and passing each of the first downhole plug and the second downhole plug through the flow column in sealing engagement with both the operating string and the liner.

3. The method as defined claim 1, wherein the step of sealing the circulation port further comprises:

providing a sealing surface on the second pump down plug; and providing a second pump down plug seal surface on the landing collar.

4. The method as defined in claim 3, wherein said step of sealingly blocking the circulation port further comprises:

providing the second pump down plug seal surface on the landing collar at a position spaced longitudinally upwardly from the circulation port; and providing an elastomeric seal on the second pump down plug for sealingly engaging the second pump down plug seal surface on the landing collar.

5. The method as defined in claim 1, wherein said step of blocking circulation through the landing collar further comprises:

providing a first pump down plug seal surface on the landing collar; and providing a sealing surface on the first pump down plug for sealingly engaging the first plug seal surface to block circulation through the landing collar.

6. The method as defined in claim 1, further comprising:

providing an axially movable piston responsive to a pressure differential between an interior of the landing collar and an exterior of the landing collar for opening the circulation port.

7. The method of claim 1, further comprising:

providing a landing collar housing about the landing collar, the housing included upper threads for connection with a respective lower portion of the liner.

8. The method as defined claim 1, further comprising:

engaging a nose portion of the second pump down plug with a rear fin portion of the first pump down plug to rotationally secure said second pump down plug within the landing collar.

9. The method as defined in claim 1, further comprising:

securing a ball seat sub to the liner below the landing collar; and pumping a ball to the landing collar for sealing with the ball seat sub.

10. The method as defined in claim 9, further comprising:

providing a hydraulic liner hanger within the wellbore liner for securing the liner in place within the wellbore; and activating the liner hanger in response to increased fluid pressure when the ball seals with the ball seat sub.

11. The method as defined in claim 1, further comprising:

using identical pump down plugs as the first and second pump down plugs.

12. A system for cementing an annulus surrounding a liner within a wellbore using a work string, the system comprising:

a landing collar having a housing and an inner body within the housing;

the inner body defining a bypass flow passageway having a circulation port for communicating with a bore within the liner longitudinally above the landing collar and a bore within the liner longitudinally below the landing collar, the landing collar including a surface controllable member for selectively blocking flow through the circulation port;

a first pump down plug for sealing with both the work string and with the liner to separate cement above the first plug from fluid below the first plug and for subsequently sealing with the landing collar; and a second pump down plug for sealing with both the work string and with the liner to separate cement below the second plug from fluid above the second plug and from subsequently sealing with the landing collar to close off the circulation port.

13. The system as defined in claim 12, further comprising:

upper and lower connectors on the landing collar housing for securing the landing collar to the liner.

14. The system as defined in claim 12, wherein said surface controllable member is a piston.

15. The system as defined in claim 12, further comprising:

a hydraulic liner hanger assembly for securing the liner within the wellbore; and a ball seat sub integral with the landing collar for setting the hydraulic liner hanger assembly.

16. A landing collar for cooperating with first and second pump down plugs for positioning cementatious material with an annulus surrounding a liner within a wellbore, the landing collar comprising:

a landing collar housing having an upper connector to secure the landing collar to the liner;

an inner body within the housing, the inner body having a central bore therethrough for circulating fluid through the landing collar, and having a bypass flow passageway for communicating with a bore within the liner longitudinally above the landing collar and a bore within the liner below the landing collar, the inner body further including a pressure sensitive valve member for controlling flow through the bypass flow passageway, the pressure sensitive valve member being responsive to pressure within the bore of the liner longitudinally above the landing collar; and the landing collar having axially spaced first and second sealing surfaces for sealing with the first and second pump down plugs, respectively.

17. The landing collar as defined in of claim 16, further comprising:

a shear member for maintaining the pressure sensitive valve member closed until fluid pressure within the liner above the landing collar reaches a preselected pressure to open the valve member.

18. The landing collar as defined in claim 17, wherein the valve member is a piston axially movable for opening the bypass flow passageway.

19. The landing collar as defined in claim 17, wherein the second sealing surface on the landing collar is spaced axially above the pressure sensitive valve member.

20. The landing collar as defined in claim 17, further comprising:

a landing collar housing positioned about the landing collar, the landing collar housing included upper threads for connection with a respective lower portion of the liner.

* * * * *